US008191257B2

(12) United States Patent
Reiner et al.

(10) Patent No.: US 8,191,257 B2
(45) Date of Patent: Jun. 5, 2012

(54) METHOD FOR ASSEMBLING A STEAM GENERATOR

(75) Inventors: Olaf Reiner, Esslingen (DE); Rolf Schmidt, Stuttgart (DE)

(73) Assignee: ALSTOM Technology Ltd., Baden (CH)

( * ) Notice: Subject to any disclaimer, the term of this patent is extended or adjusted under 35 U.S.C. 154(b) by 610 days.

(21) Appl. No.: 12/386,302

(22) Filed: Apr. 16, 2009

(65) Prior Publication Data

US 2009/0265935 A1 Oct. 29, 2009

(30) Foreign Application Priority Data

Apr. 25, 2008 (DE) ..... 10 2008 020 869

(51) Int. Cl.
*B21D 51/24* (2006.01)
*B23P 11/00* (2006.01)
*F24D 3/00* (2006.01)

(52) U.S. Cl. ..... 29/890.051; 29/890.03; 29/429; 237/58

(58) Field of Classification Search ..... 29/890.03, 29/890.051, 429; 237/58
See application file for complete search history.

(56) References Cited

U.S. PATENT DOCUMENTS

| | | | | |
|---|---|---|---|---|
| 3,751,783 | A | 8/1973 | Roberts, Jr. et al. | 29/157.4 |
| 6,588,104 | B2 * | 7/2003 | Heidrich | 29/890.051 |
| 7,296,349 | B2 | 11/2007 | Gartner et al. | 29/890.051 |
| 7,966,727 | B2 * | 6/2011 | Kawashima et al. | 29/890.051 |

FOREIGN PATENT DOCUMENTS

DE 100 14 758 10/2001

* cited by examiner

*Primary Examiner* — Alexander P Taousakis
(74) *Attorney, Agent, or Firm* — Alix, Yale & Ristas, LLP

(57) ABSTRACT

A method for assembling a steam generator includes parallel assembly of the boiler framework and preassembly of assembly modules, and hoisting of the assembly modules into the boiler framework. The outer roof section of the boiler framework roof is then assembled. The inner roof section and the internal components are assembled simultaneously with assembly of the boiler wall in the upper section of the steam generator. The segments of the external support pipes are mounted into the assembly modules and subsequently connected at their module joints the external support pipes are mounted in the final position in the outer roof section. The buckstays and the header tie bars are mounted headers to the boiler wall or to the external support pipes. The auxiliary steel structure of the assembly modules the suspension equipment of the curtain walls are dismantled.

5 Claims, 11 Drawing Sheets

METHOD FOR ASSEMBLING A STEAM GENERATOR

BACKGROUND

The invention relates to an assembly method for the rapid erecting of steam generators.

Steam generators or large-scale boilers of this type are used primarily in power plants heated with fossil fuels in which the heat, released in the combustion chamber of the steam generator through the burning of fuels, is absorbed by a working medium circulating in the steam generator and the heat energy is, for example, imparted to a turbine for power generation. In that regard, the large steam generators, which are often called single-pass boilers, are equipped with vertically arranged gas passes, in which the combustion takes place in the lower region and which are delimited by tube or boiler walls, whereby the tube or boiler walls are formed by inclined or vertically arranged tubes that are connected with each other. Arranged in the upper part of the gas pass are internal components such as economizers, reheaters, superheaters and other heating surfaces. On its outside, the boiler wall is provided with buckstays and header wall boxes, which include headers arranged on header cross-ties. Connected at the lower end of the boiler wall is a boiler hopper, which hangs above a so-called boiler base (usually the 0 m (zero meter) platform). The complete boiler to which the mentioned elements belong is arranged suspended in a boiler steel structure. The boiler steel structure rests upon a foundation that delimits the boiler base and exhibits several boiler columns, which are braced by means of crossbeams and steel structure diagonal braces and which bear a boiler top grid. The boiler top grid bears the boiler, which is provided at the top, underneath the boiler top grid, with a boiler roof.

For rapidly erecting large steam generators of this type, DE 100 14 758 C2 suggests a method that makes it possible to simultaneously construct the upper part of the boiler wall and the internal components that are to be provided there. For that purpose, the boiler top grid is divided into an outer top grid section and an inner top grid section. The boiler steel structure is first erected with the outer top grid section. The latter is configured in such a way that it provides access from the top to the volume enclosed by the boiler steel structure. By means of a crane, parts for the construction of the boiler wall, the upper boiler wall in particular, can thus be lifted in from above through an opening left in the outer top grid section. This makes it possible to assemble the upper boiler wall by means of a crane of a suitable size. Simultaneously, the inner top grid section of the boiler top grid can be constructed on the boiler base or just above same. It is held, for example, by means of tension cables having lifting systems that are anchored in the boiler steel structure, e.g., at the outer top grid section of the boiler top grid. The required internal components are now constructed underneath the inner top grid section of the boiler top grid, whereby the inner top grid section of the boiler top grid can accordingly be lifted gradually. The assembly of the upper boiler wall and the assembly of the internal components thus take place parallel in time. Because both of the assembly operations are each very time-intensive, a great deal of construction time can be saved by means of parallel assembly. Once both the upper boiler wall and the internal components have been completed, the internal components including the inner top grid section of the boiler top grid can be hoisted and fastened and connected at their installation location.

This method has been well-proven for erecting large steam generators. There is now a need, particularly in view of the recent exorbitant increases in steel prices, to further optimize and simplify this well-proven method, and to minimize the use of steel, particularly for auxiliary constructions.

It is thus the task of the invention to create a method which, along with a simple and rational construction, also allows the construction especially of large steam generators in a way that is cost-effective in terms of steel, and which is already simpler to undertake in the engineering and thus faster and more cost-effective.

SUMMARY

Through the solution in accordance with the invention, a method for assembling a steam generator is created that exhibits the following advantages:

- Clear reduction in engineering hours
- Simplification of the construction,
- Simplification of the assembling of the buckstays and the header tie bars with headers and external support pipes and simplification of the disassembly of the auxiliary constructions.

An advantageous development of the invention provides that in step a) according to the method of the inventive solution, additional segments of the external support pipes are placed or mounted on the assembly module. As a result of placing the segments of the external support pipes on the assembly modules already in the preassembly stage, i.e., on the boiler base, during the subsequent hoisting of the assembly modules into place by the crane, the support pipe segments can be hoisted into the boiler steel structure at the same time and an additional assembly step of hoisting the support pipe segments separately is saved. This means that considerable time and resulting costs are saved in terms of assembling, since the leasing of the large construction crane makes for very high operating costs.

In an advantageous further development of the invention, the support height of the buckstays on the cantilevers of the assembly modules is configured in such a way that in the hoisted state of the assembly module into the boiler steel structure, the buckstays come to lie approximately 50 mm below their final position, and the buckstays are hoisted into their intended final positions. By doing this, minor inaccuracies can be easily compensated for, and this action prevents the final position of the buckstays from being below the position on the assembly module, and the assembly operation becoming more difficult or impossible as a result.

In an advantageous development of the invention, the support height of the header cross-ties and the headers on the assembly modules is configured in such a way that in the hoisted state of the assembly modules into the boiler steel structure, the header cross-ties and the headers come to lie in their final positions. As a result of this action, the production of the connection of the headers to the particular heating surfaces or internal components to be attached is significantly simplified, since the components to be connected lie at the same height (final position) and weld joints can be easily applied.

An advantageous further development of the inventions provides that additionally in step a) according to claim 1, along with the erecting of the boiler steel structure, the preassembly of assembly modules or curtain walls for the boiler side walls takes place simultaneously on the boiler base outside the boiler steel structure quad, whereby the assembly module consists of a self-supporting auxiliary steel structure on which buckstays are placed, that additionally in step b) according to claim 1, the preassembled curtain walls are hoisted, placed on the boiler steel structure of the upper section of the steam generator and affixed to same, that additionally in step j) according to claim 1, the buckstays that are lying free on the assembly modules or curtain walls for the boiler side walls are connected to the boiler wall, and that additionally in step k) according to claim 1, the subsequent dismantling of the assembly modules or the curtain wall cross-ties takes place on the boiler side walls by means of suspension equipment. Through this measure, the boiler side walls can also be assembled in a cost-efficient way.

BRIEF DESCRIPTION OF THE DRAWINGS

The present disclosure may be better understood and its numerous objects and advantages will become apparent to those skilled in the art by reference to the accompanying drawings in which.

DETAILED DESCRIPTION

Figure 1:
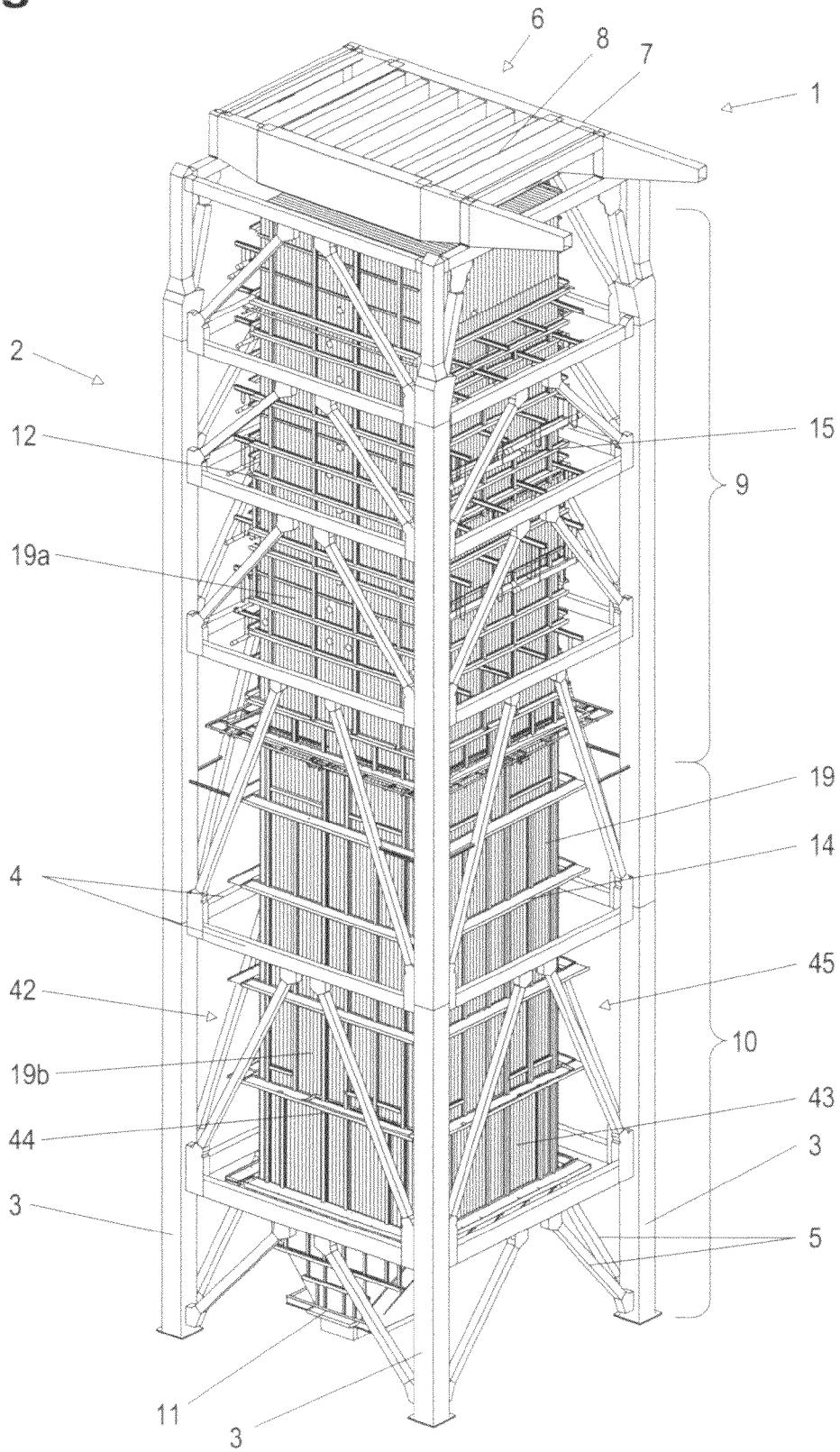
FIG. 1 is a schematicized, perspective and cutaway representation of a substantially completely assembled gas flue of a steam generator.

Illustrated in FIG. 1 is a steam generator 1 in tower construction form that is borne by a boiler steel structure 2. Included in the boiler steel structure 2 are vertically arranged boiler columns 3 that rest on suitable foundations. The boiler columns 3, which are arrayed in a square and arranged vertically, are connected with each other by horizontal boiler steel structure cross-beam 4, which are arranged in tiers. Steel structure diagonal braces 5 are provided for stiffening. On top, the boiler steel structure 2 bears a boiler top grid 6, which is divided into an outer top grid section 7 and an inner top grid section 8. The outer top grid section 7 rests on the boiler steel structure 2 and is connected with same. The inner top grid section 8 is borne by the outer top grid section 7 and is connected with same. The contour, i.e., the maximum external dimensions of the inner top grid section 8 are at least somewhat smaller than the inside width of the space enclosed by a boiler wall 19 inside the steam generator 1, at least in its upper section 9. In this section, the illustrated steam generator 1 is provided with vertical piping (boiler wall 19*a* in upper section 9).

Provided in section 9 of the steam generator 1 are internal components, which include economizers 21, 22, reheaters 23, 24 and superheater 25. Each of these is formed by horizontally arranged tube bundles or heating surfaces that extend transversely through the gas pass defined by the steam generator 1 and whose connections are routed through the boiler wall 19, its section 19*a* in particular. The latter is surrounded externally by buckstays 12 that secure the boiler wall 19*a* against explosions and support it towards the outside and are borne by it. The buckstays are connected to each other and with the boiler wall 19*a* at boiler corner regions. In addition, the buckstays 12 that are formed by horizontal, stiff girders are connected to each other by vertical girders, so-called stanchions 36. The number of internal components or heating surfaces 21, 22, 23, 24, 25 cited above is cited by way of example. It is also possible for more or fewer economizer, reheater and superheater heating surfaces to be arranged.

In another section 10 lying under that, the steam generator is piped diagonally (boiler wall 19*b* in section 10). However, the piping can also be selected differently as needed. The diagonally piped parts of the boiler wall 19*b* are again provided with buckstays 14 that secure the boiler wall 19*b* against explosions and support it towards the outside and are borne by it. Connected toward the bottom is a boiler hopper 11 that is also equipped with buckstays.

Figure 10:
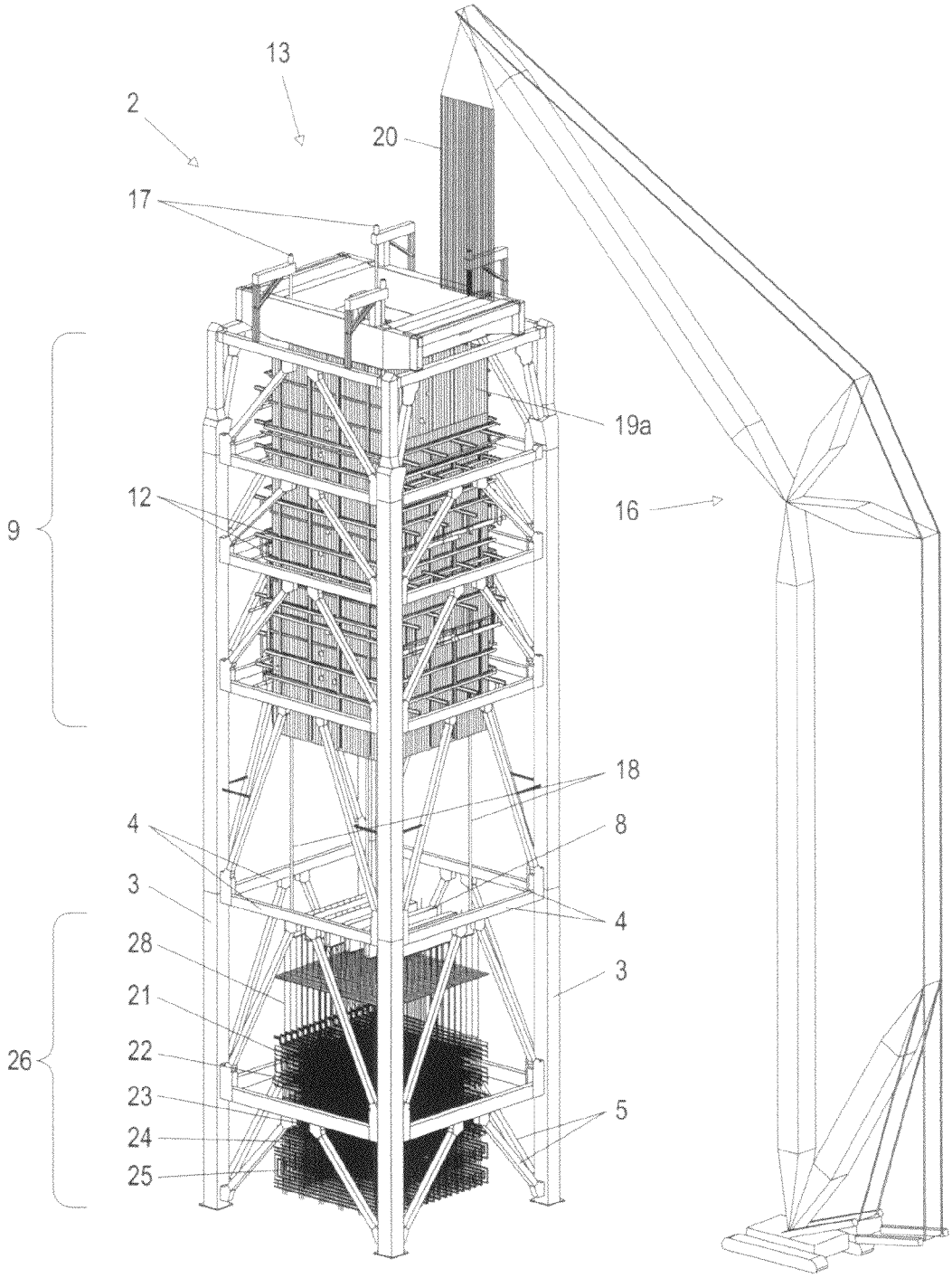
FIG. 10 is a construction phase in which boiler walls and downstream heating surfaces (internal components) are assembled at the same time.

The steam generator 1 exhibits at least one gas pass 13 (FIG. 10). It is delimited by boiler walls 19, which are configured as tube walls and are assembled suspended on the boiler top grid 6, and which bear buckstays 12, 14. In addition, assembled on the outside of the gas pass are header wall boxes 15, which surround the headers 33 as well as additional components such as header insulations, not shown in detail. The headers 33 are held by devices, not specified in detail, held suspended or lying on header cross-ties 32, each of which is held with its one end at the boiler wall 19*a* and with its other end on external support pipes 41 (FIG. 5), which are also held or supported on the boiler top grid 6 by means of devices that are not specified in detail. The complete boiler or steam generator 1 that has been constructed in this way is borne suspended from the boiler top grid 6.

The sequence of erecting the steam generator 1 that has so far been illustrated in overview fashion is illustrated in FIGS. 2 through 11.

Figure 2:
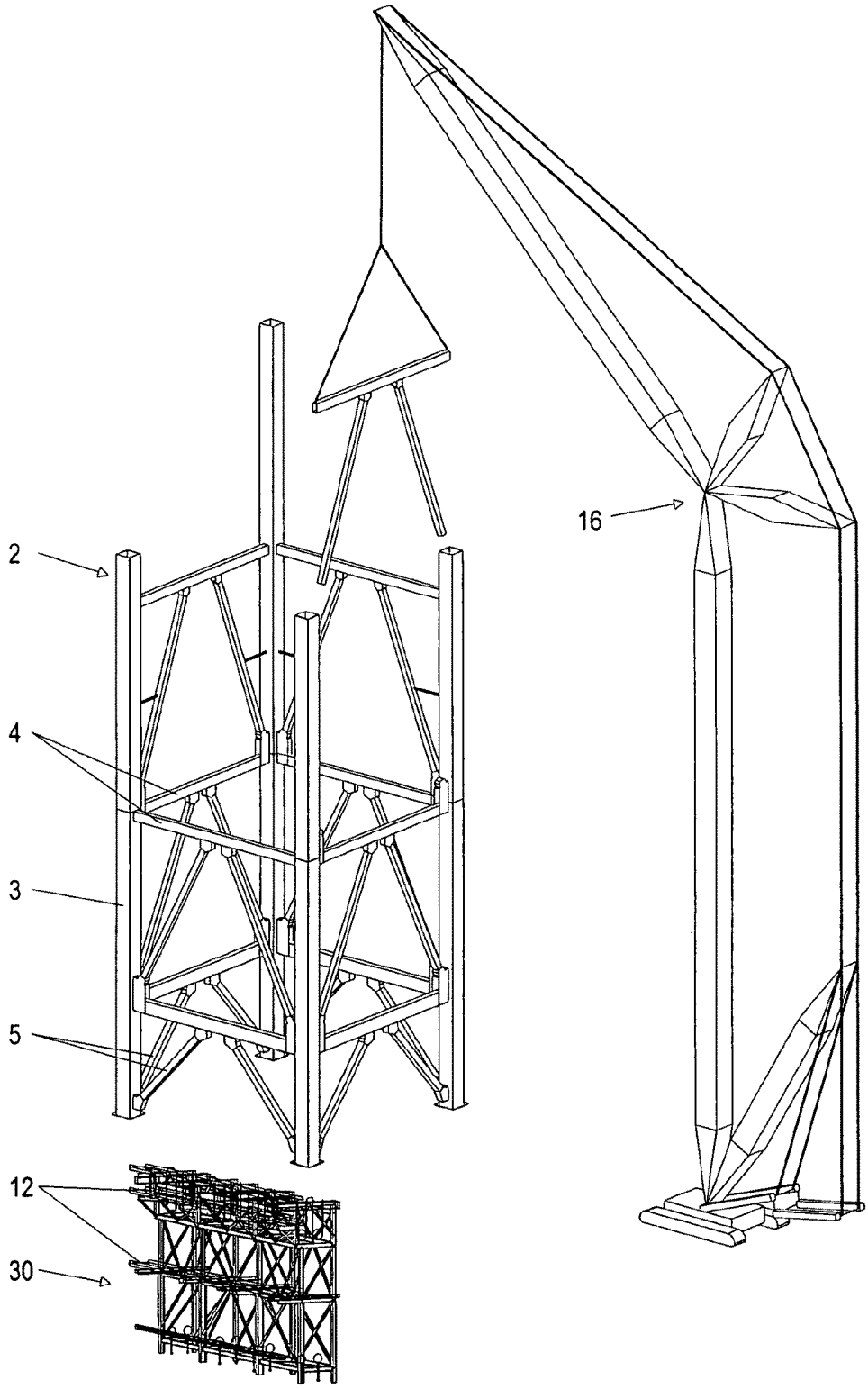
FIG. 2 is a partially erected boiler framework and an already erected assembly module along with an assembly crane.

As FIG. 2 illustrates, work is begun with the assembly of the boiler steel structure 2 in that the boiler steel structure columns 3 and the associated boiler steel structure cross-beam 4 and boiler steel structure diagonal braces 5 are built up tier by tier. This assembly takes place with a crane 16 or with several cranes. At the same time, assembly modules 30 are preassembled on the boiler steel structure base outside of the boiler steel structure quad (the quad or the area that is enclosed or, so to speak, framed in by the four boiler steel structure columns) and within reach of the crane, or are placed at this location in the preassembled state. Following the preassembly, the assembly modules 30 are completely finished so they are available for the rest of the assembly procedure.

Figure 3:
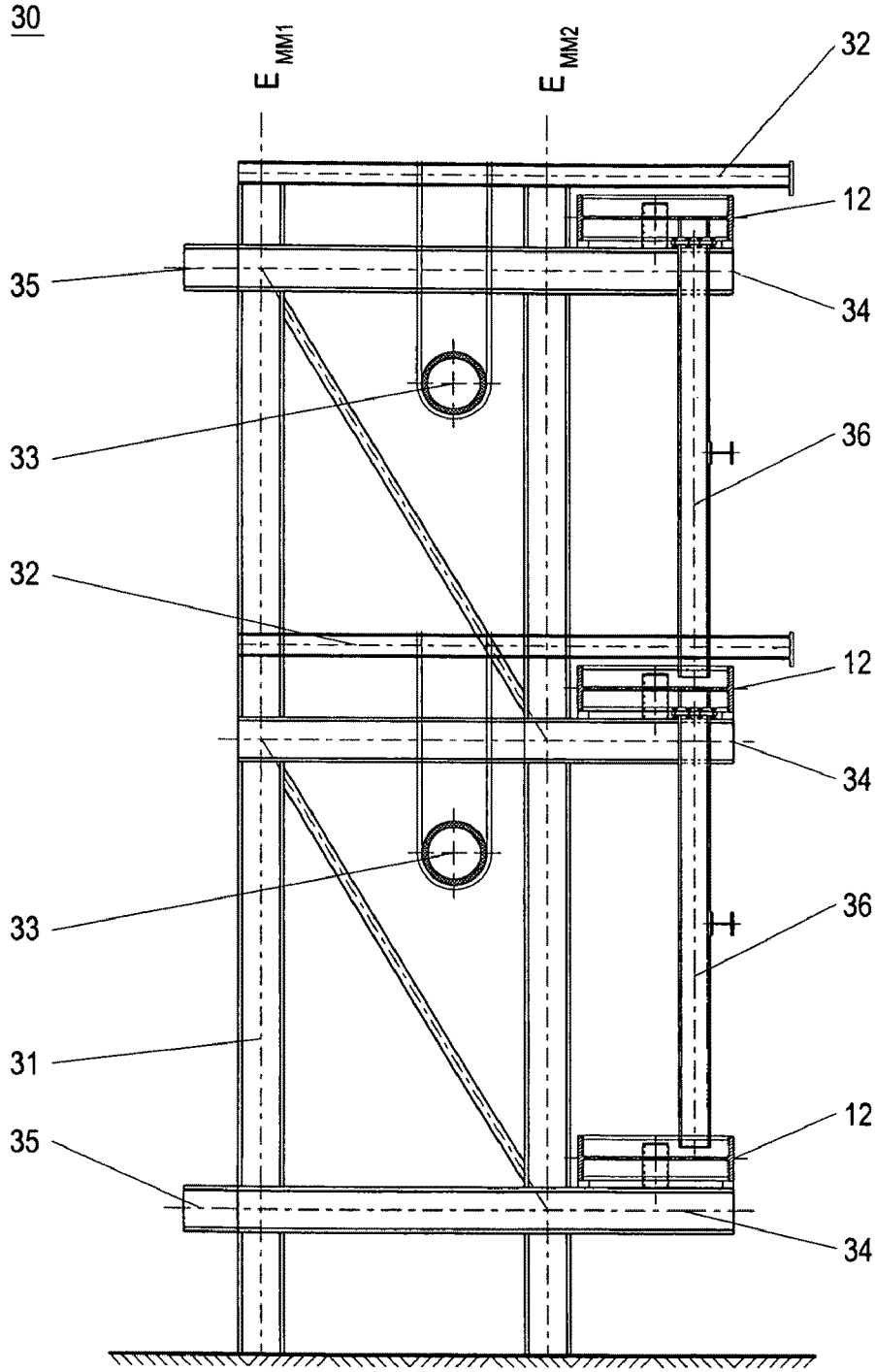
FIG. 3 is a completely erected assembly module illustrated in cross section with placed buckstays and header tie bars, including headers mounted thereon.

FIG. 3 shows by way of example a cross section of one of the assembly modules 30, each of which exhibits a self-supporting auxiliary steel structure 31, which is preassembled in standalone vertical fashion and which exhibits the width of the boiler front wall 42 and the boiler rear wall 43 and, if also applied or used for the boiler side walls, the width of the boiler side walls 44, 45. The buckstays 12, header cross-ties 32 with the headers 33 mounted thereon, and segments of the external support pipes 41 are placed on and secured to the particular preassembled auxiliary steel structures 31 of the assembly modules 30. In this regard, it is a feature essential to the invention that the auxiliary steel structure 31 of the assembly modules 30 is self-supporting and the buckstays 12, header cross-ties 32 with headers 33 and segments of the external support pipes 41 placed free thereon are not integrated with the auxiliary steel structure 31 as bearing or supporting components. This simplifies the preassembly of the assembly modules 30 themselves, since no connections by means of welding or suchlike have to take place between the auxiliary steel structure 31 and the buckstays 12, the header cross-ties 32 with headers 33 and segments of the external support pipes 41. In addition, the later assembly of the buckstays 12, header cross-ties 32 with headers 33 and segments of the external support pipes 41 is made very easy, since the buckstays 12, header cross-ties 32 with headers 33 and segments of the external support pipes 41 all can be simply hoisted from the auxiliary steel structure 31 and assembled (in the case of the buckstays 12) or welded to each other, in the case of the segments of the support pipes 41, without being loosened from a bearing or support construction. In the event that the assembly modules 30 are also used on the boiler side walls 44, 45, the assembly modules 30 for the boiler side walls 44, 45 are fitted only with buckstays 12, but not with header cross-ties 32 and not with the headers 33 mounted thereon, and also not with segments of the external support pipes 41.

The height of the preassembled assembly modules 30 depends on their weight, i.e., in each case on the weight of the supporting auxiliary steel structure 31 including the weights of the buckstays 12, the header cross-ties 32 and headers 33, and the segments of the external support pipes 41 placed on it, as well as on the hoisting capacity of the crane. In certain cases, the insertion of the segments of the external support pipes 41 can be omitted in order to avoid assembly modules 30 that are too heavy. By omitting the segments of the external support pipes 41, the assembly modules 30 can be built higher, and fewer assembly modules 30 are required as a result. In those cases in which the assembly modules 30 are preassembled without the segments of the external support pipes 41 and are hoisted onto the boiler steel structure 2, the segments of the external support pipes 41 are hoisted separately by the crane 16 or another hoisting apparatus onto the assembly module 30, which is by then already supported in the boiler steel structure 2, and are suspended or mounted therein.

Figure 5:
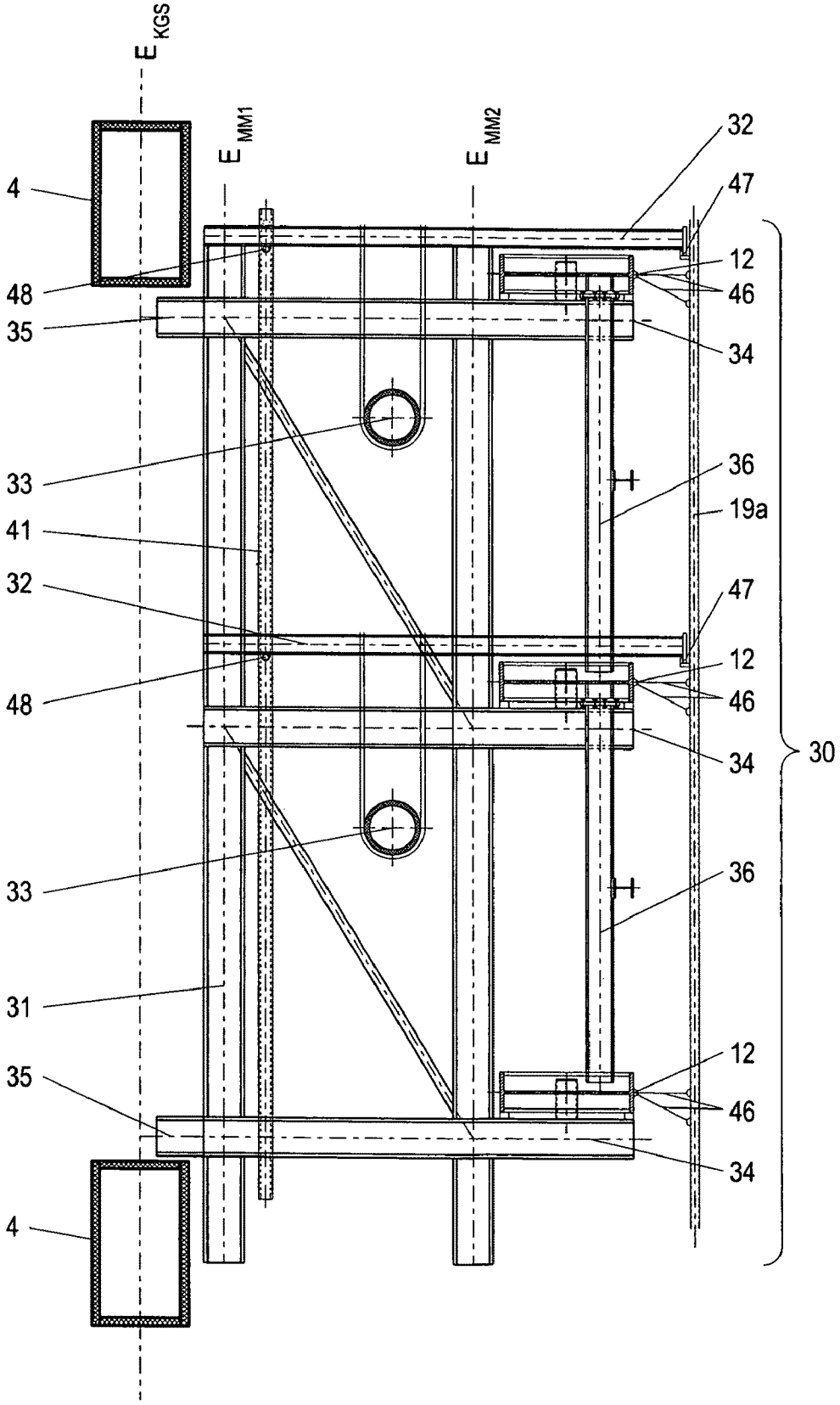
FIG. 5 is a schematicized representation and a vertical longitudinal section of the boiler framework and its beams with assembly module supported thereon in the upper section of the steam generator, whereby the connection of the buckstays and header tie bars with the boiler wall and external support pipe is illustrated enlarged compared with FIG. 4.

The assembly modules 30 exhibit in cross section two planes EMM1, EMM2 (corresponding to the center lines of the two assembly module columns), which come to lie within the boiler steel structure support plane EKGS (corresponding to the center line of the boiler steel structure support 2) and the boiler wall 19*a* when the assembly modules 30 are subsequently hoisted and placed into the boiler steel structure 2 (see FIG. 5). Projecting in the direction of the boiler wall 19*a* from plane EMM2 on the boiler wall side of the assembly modules 30 are cantilevers 34, on which are placed the buckstays 12 and the stanchions 36 mounted on same, whereby the stanchions are connected in fixed fashion (fixed point) at its top end with the buckstay 12 bordering at the top, and connected in removable fashion (floating point) at its bottom end with the buckstay 12, bordering at the bottom. Also projecting outward from plane EMM1 on the boiler steel structure support side of the assembly modules 30 are cantilevers 35, which serve for the placing and support of the assembly modules 30 on the boiler steel structure cross-beam 4 and boiler steel structure diagonal braces 5. By means of the cantilevers 35, the vertical and horizontal loads that occur during supporting of the assembly modules 30 are transmitted into the boiler steel structure 2.

In terms of their height, the cantilevers 34 for the buckstays 12 are mounted on the assembly modules 30 in such a way that when assembly modules 30 are hoisted into the boiler steel structure 2, the buckstays 12 come to lie somewhat below their final installation position in order to be subsequently hoisted by 50 mm, for example, and brought into their final installation positions. By contrast, the header cross-ties 32 with headers 33 and the segments of the external support pipes 41 are placed in or mounted on the assembly modules 30 at the final position height so that during the later assembly their ends only have to be connected or welded (external support pipe 41) to corresponding equipment. Each assembly module 30 is built or preassembled exactly to its area of application within the boiler steel structure 2 or the boiler wall region assigned to it, and the heights for the placement of the buckstays 12 and the header cross-ties 32 with the headers 33 are selected accordingly. The height or length of the particular segments of the external support pipes 41 correspond to the height of the particular assembly module 30, less a small amount of play for welding the particular segments to each other.

Figure 4:
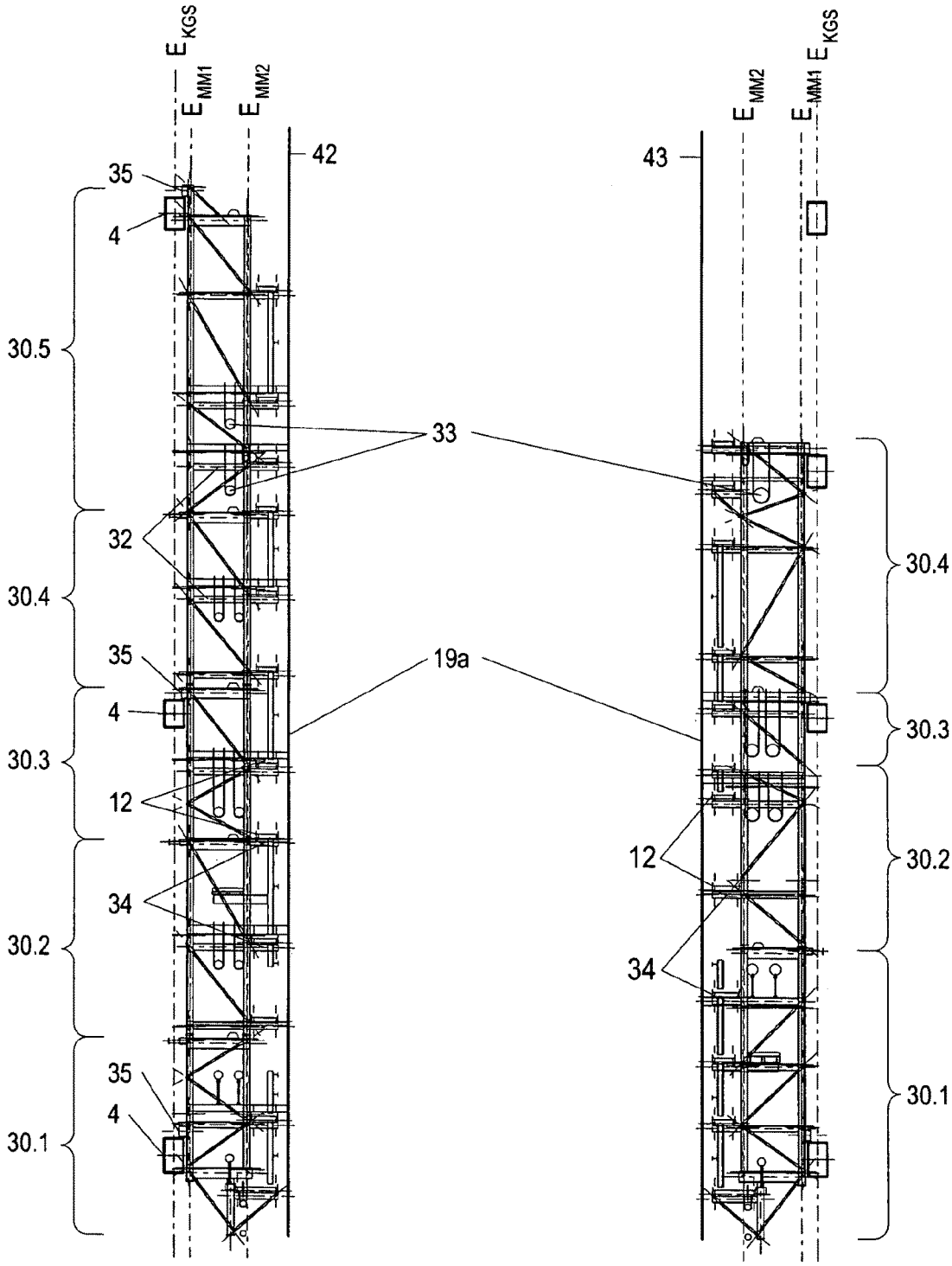
FIG. 4 is a schematicized representation and as a vertical longitudinal section of the boiler framework and its beams with assembly modules supported thereon in the upper section of the steam generator, showing the boiler front wall and boiler back wall.

With further progress in the construction of the boiler steel structure 2, i.e., when the boiler columns 3 have reached their desired height or at least a minimum height, the next work step is that the preassembled assembly modules 30 are hoisted onto the boiler steel structure 2 and placed there by means of a crane 16. In that regard, the sequence of the assembly modules 30 that are to be hoisted and placed must be adhered to with all exactness so that the assembly modules 30 come to lie at their intended boiler wall regions. Consequently, the lowest assembly module, 30.1, i.e., the assembly module that provides the buckstays 12, header cross-ties, 32 with headers 33 and segments of the external support pipes 41 for the bottom region of the boiler wall 19*a* is the first to be hoisted onto the boiler steel structure 2 and placed therein, and the next assembly module 30.2, which provides the upwardly adjacent boiler wall region with buckstays 12, header cross-ties 32 with headers 33 and segments of the external support pipes 41, is subsequently to be set upon the lower assembly module 30.1 and placed. In the same way, all of the assembly modules 30.1, 30.2, 30.3, 30.4, 30.5 are hoisted onto the boiler steel structure 2 and are supported on the particular assembly module standing underneath, and secured or fixed in place to the boiler steel structure cross-ties 4 and boiler steel structure diagonal braces 5 via the cantilevers 35, whereby each new assembly module 30 that is placed on top is connected in fixed fashion with the one below. Depending on the position of the boiler steel structure cross-ties 4, it is also possible that one or more of the assembly modules 30.2, 30.3, 30.4, 30.5 is or are not supported on and connected to the assembly module 30.1, 30.2, 30.3, 30.4 underneath, but is or are in turn supported via the cantilevers 35 on the boiler steel structure tie bar(s) 4. The manner of construction, which is illustrated in FIG. 4, is applicable for the boiler wall 19*a* at the boiler front wall 42 and boiler rear wall 43, and if applied in this way as well, for the two boiler side walls 44, 45.

Through the inventive hoisting of the assembly modules 30 into place already during the boiler steel structure construction stage and not later after the boiler steel structure construction has taken place, including placement of the outer top grid section 7 of the boiler top grid 6, substantial simplifications of assembly result. Through the inventive hoisting of the assembly modules 30 into place, they are hoisted directly to their installation height in the boiler steel structure 2, and not, as provided in the state of the art, just hoisted to the full height of the boiler steel structure 2 and subsequently hoisted or lowered through the opening of the outer top grid section 7 of the boiler top grid 6 in the boiler steel structure 2. Thus, significantly shorter hoisting times result for the crane 16, along with significantly simplified assembly procedures, which leads to substantial savings of costs and time.

Figure 6:
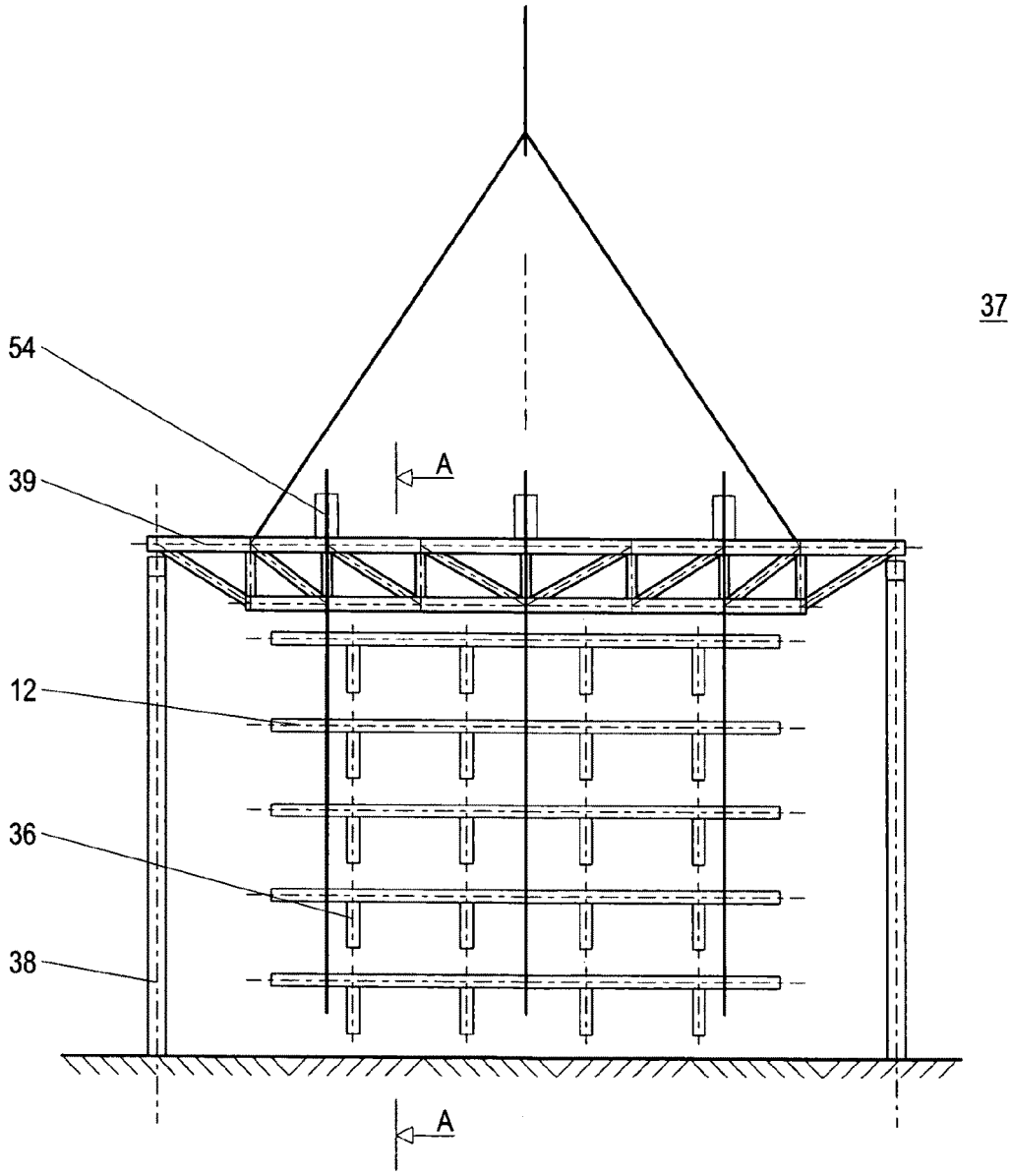
FIG. 6 is a schematicized representation and illustrated as an elevation of the preassembled curtain wall with inserted buckstays.
Figure 7:
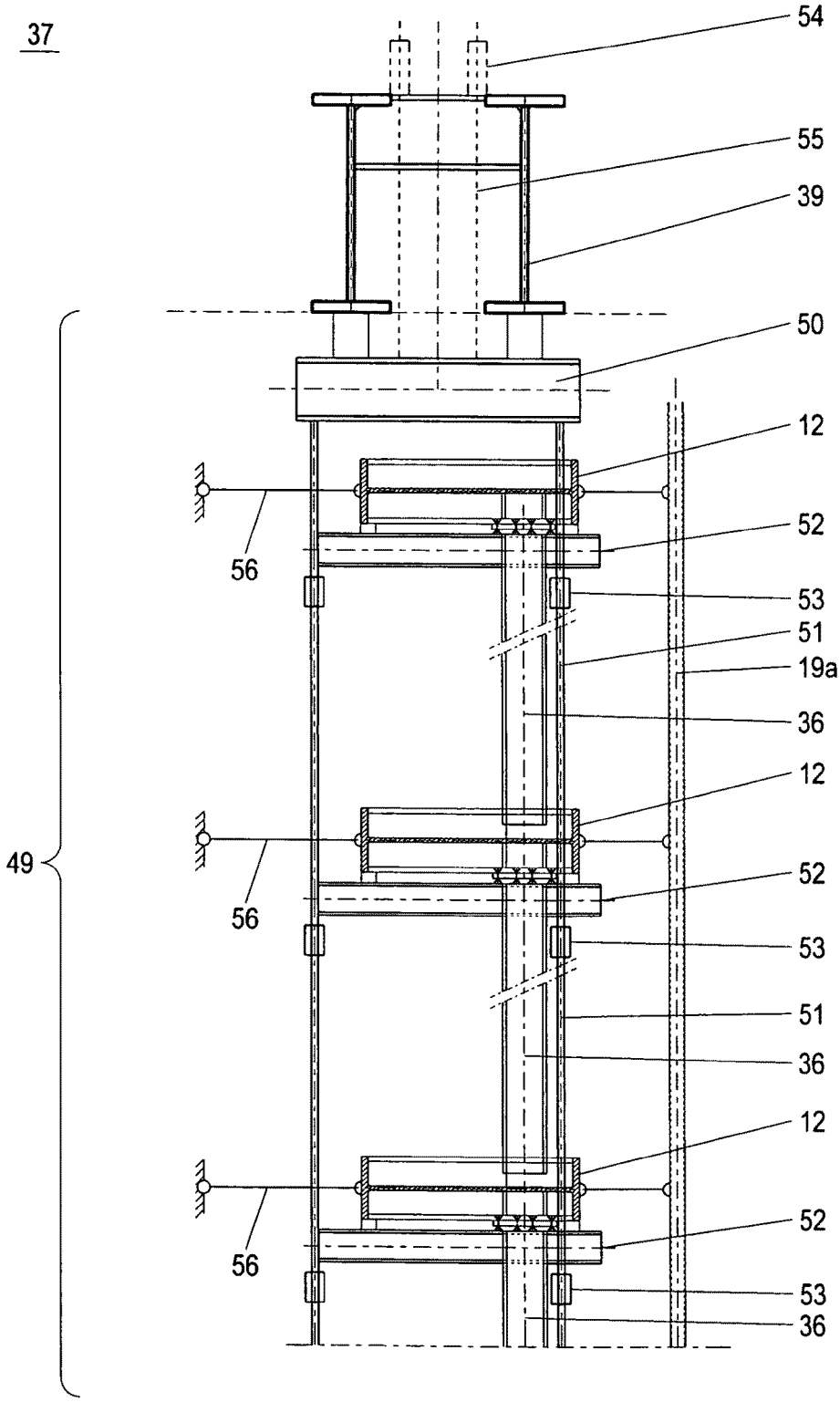
FIG. 7 is a cross-sectional view taken along line A-A in FIG. 6 of the preassembled curtain wall, whereby the preassembled curtain wall is shown in the hoisted state inside the boiler framework, the lifting strand system with tension cables that is shown with dashed lines (Pos. 54 and 55) is required only in the preassemble state on the boiler base.
Figure 8:
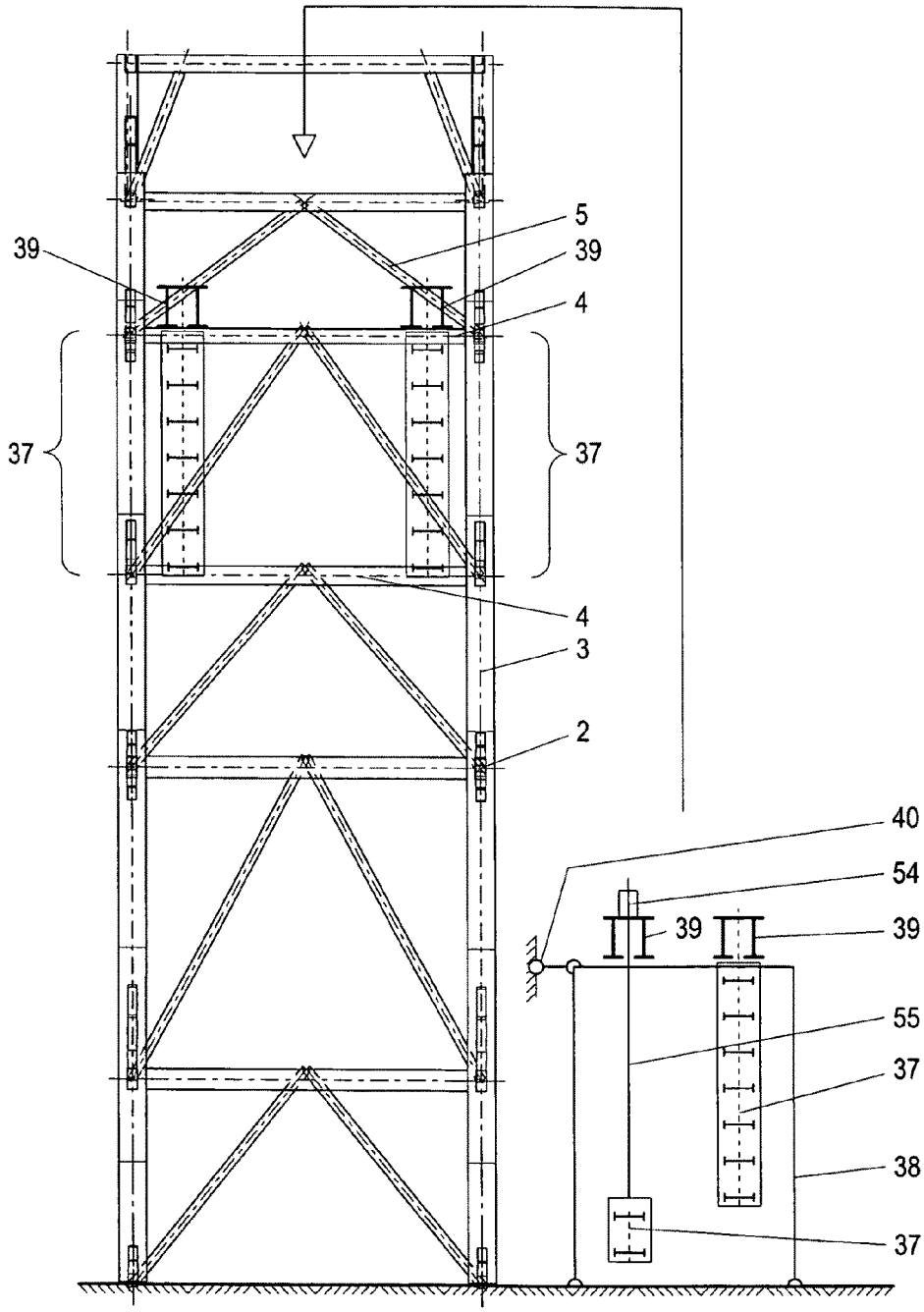
FIG. 8 is the construction phase in which, additionally, most of the boiler framework has been erected and two of four curtain walls have already been hoisted into the boiler framework while two others are in preassembly.
Figure 9:
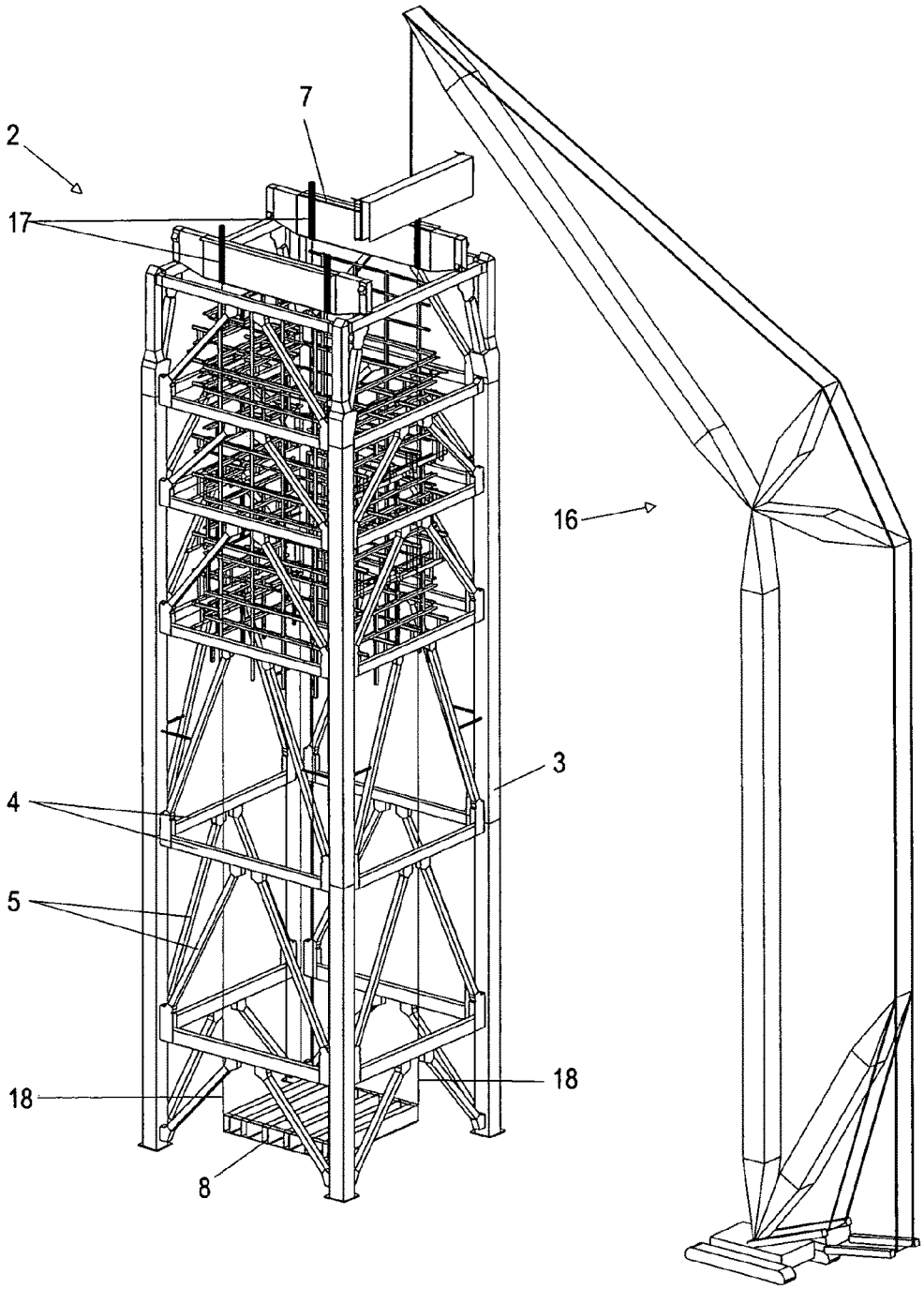
FIG. 9 is another construction phase in which the outer roof section of the boiler framework roof, including a lifting strand system, has been assembled.

The assembly modules 30, which according to the invention are brought in at the boiler front and rear walls 42, 43, can also be used at the boiler side walls 44,45 as needed. Since the boiler wall 19*a* normally does not exhibit any headers 33 on the two boiler side walls 44, 45 (as a rule, they are arranged on the boiler walls 19*a* of the boiler front wall 42 and boiler rear wall 43), the assembly module 30 used for inserting the buckstays 12, header cross-ties 32 with headers 33 and segments of the external support pipes 41 onto the boiler steel structure 2 with regard to the boiler front and rear walls 42, 43 can be simplified for just the insertion of the buckstays 12 on the boiler side walls 44, 45. FIG. 6 as an elevation and FIG. 7 as a cross section show the structure of this simplified module in which by means of an auxiliary construction designated as curtain wall 37, buckstays 12 can be preassembled on the boiler base in such a way that after being hoisted into the boiler steel structure 2, the buckstays 12 come to lie in their final position and can be connected with the boiler wall 19*a* with suitable progress in the construction. The preassembly of the curtain walls 37 takes place in a self-supporting assembly frame 38, which can also be hinged horizontally on fixed points 40, such as a hopper steel structure, boiler steel structure or stair tower, for example. Alternatively, the assembly frames 38 can also be designed freestanding. On the assembly frames 38 is a curtain wall tie bar 39, on which the buckstays 12 with stanchions 36 suspended beneath are hoisted incrementally on tension cables 55 of a lifting strand system 54 by means of suspension equipment 49 consisting of topmost distribution beam 50, hanger 51, buckstay girder 52 and hanger connector 53, and are suspended underneath when the upper limit stop is reached. In that regard, on the suspended hanger 51 with buckstay girder 52, newly hoisted suspended by means of the incremental hoisting, buckstay 12 after buckstay 12 is inserted into the curtain wall 37. Once curtain wall 37 has reached the topmost position (construction height equals final height), the curtain wall 37 is reloaded from the lifting strand system 54 directly onto the curtain wall tie bar 39, i.e., is suspended on the latter. The lifting strand system 54 is disassembled and is no longer required for the further assembly of this curtain wall 37. FIG. 8 shows a curtain wall 37 fully preassembled on the boiler base, along with a curtain wall 37 being formed.

After all of the assembly modules 30 and, if used, curtain walls 37 (FIG. 8 shows by way of example two curtain walls 37 that have already been hoisted into the boiler steel structure 2, while the curtain walls 37 to be mounted over them are still on the boiler base) are hoisted into the boiler steel structure 2, if this has not already been done, the boiler steel structure 2 is completed and the curtain walls 37 are secured against the wind by means of attachment points 56 on the boiler steel structure 2. As the next work step, the outer top grid section 7 of the boiler top grid 6 is assembled onto the boiler steel structure 2, in particular, on its topmost boiler steel structure beams 4. For that purpose, corresponding parts are placed onto the boiler steel structure 2 with the crane 16 so that the outer top grid section 7 is assembled at the installation location (see FIG. 9). At the same time, the inner top grid section 8 is preassembled on the boiler steel structure base or is brought to this location in an already preassembled state. Here, the inner top grid section 8 lies centered between the boiler steel structure columns 3, which have been placed in a square or rectangle. The inner top grid section 8 preferably exhibits a rectangular or square shape that corresponds to the shape of the gas pass 13—but somewhat smaller than the latter.

Assembled now on the outer top grid section 7 is, for example, a lifting strand system 17 consisting of several lifting strand devices having tension cable bundles 18 that are connected to each of the corners of the inner top grid section 8.

With this construction stage, the building of the boiler steel structure 2, including the assembly modules 30 supported thereon and, if used, the curtain walls 37 mounted therein, is essentially completed and the simultaneous assembling of the boiler wall 19*a* in the upper section 9 and the building of the internal components below the inner top grid section 8 can now begin. This operation is illustrated in FIG. 10. To build the boiler wall 19*a*, individual preassembled boiler wall parts 20 (pressurized tube wall parts) are inserted with the crane 16 from above into the space enclosed by the assembly modules 30 that have been placed into the boiler steel structure 2 and, if applied or used, by the curtain walls 37, and are fastened suspended from the outer top grid section 7. The boiler wall 19*a* is thus built register by register. The gas pass 13, which is delimited thereby and is already originating in its upper section 9, still has a free cross section.

Simultaneously with the installation of the boiler wall parts 20 for erecting the boiler wall 19*a*, however, the internal components are being built at another construction site. For that purpose, in each case the lifting strand system 17 hoists the inner top grid section 8 to an extent such that the internal components can be built step by step, and holds it at that height. Once the inner top grid section 8 of the boiler top grid 6 has been hoisted to a first height, the boiler roof is then built under that and fastened in suspended fashion.

After that, the inner top grid section 8 is hoisted to a next assembly height so that a first economizer heating surface 21 can be driven under the boiler roof and fastened with the support pipes 28 to the inner top grid section 8. After additional hoisting, a second economizer heating surface 22 follows. Now, step by step, in each case the inner top grid section 8 is hoisted and, as illustrated in FIG. 10, a first reheater heating surface 23 and a second reheater heating surface 24 are assembled suspended on support pipes 28. After further hoisting of the inner top grid section 8, a superheater heating surface 25 can be assembled, arranged at the bottom. The heating surfaces 21 through 25 are downstream heating surfaces.

Approximately simultaneously with the conclusion of the fabrication of the boiler roof and the assembling of the suspended internal components 21 through 25, in the meantime the boiler wall 19*a* has also been completed. The inner top grid section 8, the boiler roof and the internal components require an approximately cuboid space. The boiler walls 19*a* also enclose a cuboid space. However, the latter is at least somewhat larger in its horizontal section than the horizontal section of the space taken up by the internal components and the inner top grid section 8.

Figure 11:
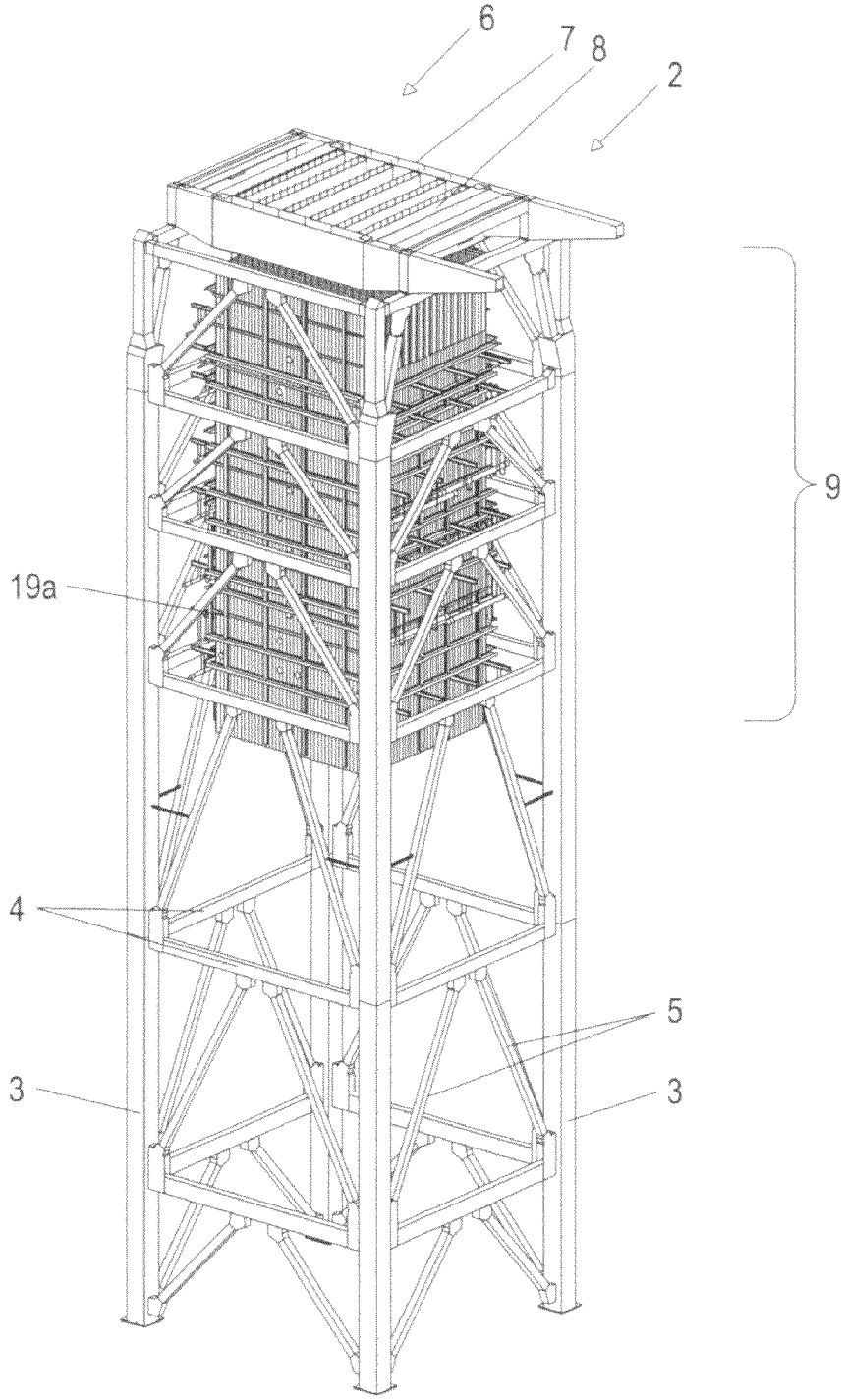
FIG. 11 is a construction stage in which the downstream heating surfaces (internal components) are hoisted after their preassembly in their installation position and have been fastened in same.

In a next assembly step, illustrated in FIG. 11, the construction unit 26 comprised of the inner top grid section 8 and the internal components 21 through 25 is now hoisted and thus inserted from the bottom toward the top into the gas pass between the boiler walls 19*a*. In that regard, the inner top grid section 8 is brought up into a corresponding seating opening or to a corresponding seating means of the outer top grid section 7 and is fixed in place here. For example, the top grid sections 7, 8 are bolted or welded to each other. In addition, the internal components 21 through 25 are connected (welded together).

Following completion of the assembling of the boiler walls 19*a* and the internal components 21 through 25, the segments of the external support pipes 41 mounted in the assembly modules 30 are connected or welded to each other in the vertical direction and suspended on the outer top grid section 7 of the boiler top grid 6 by means of devices not specified in detail. In the event that the segments of the external support pipes 41 are not mounted in the assembly modules 30, they are now, at the latest, hoisted by means of the crane 16 or another hoisting apparatus, the segments are connected, i.e., welded, to each other in the vertical direction and suspended on the boiler top grid 6. Subsequently, the buckstays 12 that are lying on the assembly modules 30 nearly in their final position (e.g., 50 mm lower) are hoisted into their final position and connected with the boiler wall 19*a*. The header cross-ties 32 that are already lying in their final position on the assembly modules 30 are connected with the boiler wall 19*a* and the external support pipes 41.

The assembling of the buckstays 12 and the header cross-ties 32 can take place independently of each other, whereby the sequence can be freely chosen. This advantageous manner of construction assembly is based on the inventive assembly modules 30, in which the buckstays 12 and header cross-ties 32 with headers 33 lie free (or possibly are secured) on the assembly modules 30 without themselves taking on any support function within the assembly module 30. FIG. 5 shows the connection of the buckstays 12, e.g., by means of a continuous pendulum attachment 46 on the boiler wall 19*a* as well as the connection of the header tie bar 32 to the boiler wall 19*a*, e.g., by means of a cleat shoe 47, and to the external support pipes 41 by means of cleat connection 48. Following the connection of the buckstays 12 with the boiler wall 19*a*, the header tie bar 32 with the boiler wall 19*a* and the external support pipes 41, and the headers 33 with the internal components 21 through 25 and with the boiler wall 19*a*, the assembly modules 30 and their auxiliary steel structure 31 can be dismantled.

In the event that assembly modules 30 are used at the boiler side walls 44, 45, the buckstays 12 are connected with the boiler wall 19*a* as described above with the boiler front and rear walls 42, 43. If curtain walls 37 are brought into the boiler steel structure 2 at the boiler side walls 44, 45, the buckstays 12 provided in the curtain walls 37 can now be connected with the boiler wall 19*a* (in accordance with the connection of the buckstays 12 per FIG. 5), for example, by means of the continuous pendulum attachment 42. Following the assembly of the buckstays 12 to the boiler wall 19*a* of the boiler side walls 44, 45, the curtain wall cross-ties 39 can be dismantled with the suspension equipment 49.

In the following, the vertically or diagonally piped boiler wall 19*b* is assembled in section 10 and the boiler hopper 11 in order to obtain the finished steam generator 1 per FIG. 1.

Assembly thus takes place in accordance with a new assembly logistics that includes the following steps:

1. Assembly of the boiler steel structure 2 and in parallel with that, preassembly of assembly modules 30 with buckstays 12, header cross-ties 32 including mounted headers 33 and possibly segments of the external support pipes 41, and hoisting of the assembly modules 30 into the boiler steel structure 2,
2. Assembly of the outer roof section 7 of the boiler framework roof 6,
3. Assembly of the inner roof section 8 and the internal components 21, 22, 23, 24 and 25, and simultaneously with that, assembly of the boiler wall 19*a* in the upper section 9 of the steam generator 1 as well as the simultaneous, if it has not yet taken place, hoisting and mounting of the segments of the external support pipes 41 into the assembly modules 30 and subsequent connecting of the segments of the external support pipes 41 at their module joints and mounting of the external support pipes 41 in the final position in the outer roof section 7,
4. Assembly of the buckstays 12 and the header cross-ties 32 including mounted headers 33 to the boiler wall 19*a* or to the external support pipes 41 by hoisting the assembly modules 30 from the auxiliary steel structure 31,
5. Dismantling of the auxiliary steel structure 31 of the assembly modules 30,
6. Assembly of the diagonally piped boiler wall 19*b* arranged in the other (bottom) section 10 of the steam generator 1 and
7. Assembly of the boiler hopper 11.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. Method for assembling a steam generator including at least a boiler steel structure, a boiler steel structure top grid having an outer and an inner top grid section, and a gas pass delimited by a boiler wall around which buckstays and header wall boxes are arranged and in which internal components are arranged, the boiler steel structure defining an inner area forming a quad, the method comprising the following steps:

a) erecting the boiler steel structure and simultaneously preassembling assembly modules for boiler front walls and rear walls on the boiler base exterior to the boiler steel structure quad, whereby each assembly module is comprised of a self-supporting auxiliary steel structure on which are placed buckstays and header cross-ties with headers mounted thereon;

b) hoisting the assembly modules, placing the assembly modules onto the boiler steel structure to form a steam generator assembly wherein each subsequent assembly module is placed above an upper prior assembly module of the steam generator assembly and affixed to the steam generator assembly;

c) hoisting the outer top grid section of the boiler steel structure top grid, placing the outer top grid section of the boiler steel structure top grid on the boiler steel structure, and affixing the outer top grid section of the boiler steel structure top grid to the boiler steel structure;

d) simultaneously with or immediately after step c), preassembling the inner top grid section of the boiler steel structure top grid on the boiler base inside the boiler steel structure quad;

e) placing a lifting strand system having downward extending tension cables on the outer top grid section;

f) preassembling register by register areas of the boiler wall, inserting the areas of the boiler wall into the boiler steel structure from above through the outer top grid section, and affixing the areas of the boiler wall to the outer top grid section;

g) preassembling the internal components in a lower region of the boiler steel structure with the inner top grid section during the building of the boiler wall, subsequently hoisting the inner top grid section and the internal components with the lifting strand systems up to an installation location in an upper region of the gas pass, and connecting the inner top grid section with the outer top grid section;

h) hoisting segments of the external support pipes onto the assembly modules if the segments of the external support pipes had not been placed on the assembly modules during step a);

i) welding the segments of the external support pipes to each other and to any external support pipes suspended on the outer top grid section;

j) connecting the buckstays lying free on the assembly modules to the boiler wall, connecting the header cross-ties lying free to the boiler wall and the external support pipes, and connecting the headers with the boiler wall and with the internal components; and k) subsequently dismantling the assembly modules and the lifting strand system.

2. Method according to claim 1, wherein step a) further comprises placing or mounting segments of the external support pipes on the assembly module.

3. Method according to claim 1, wherein the assembly modules have cantilevers and the buckstays have a placement height on the cantilevers of the assembly modules whereby when the assembly modules are the hoisted state into the boiler steel structure, the buckstays are positioned substantially 50 mm below an intended final position and the buckstays are positioned substantially at an intended final position.

4. Method according to claim 1, wherein the header cross-ties and the headers on the assembly modules have placement heights whereby when the assembly modules are the hoisted state into the boiler steel structure, the header cross-ties and the headers are positioned substantially at an intended final position.

5. Method according to claim 1, wherein step a) further comprises preassembling curtain walls for the boiler side walls, simultaneously with erecting the boiler steel structure, on the boiler base exterior to the boiler steel structure quad;

step b) further comprises hoisting the preassembled curtain walls, placing the curtain walls onto the boiler steel structure of an upper section of the steam generator assembly, and affixing the curtain walls to the upper section of the steam generator assembly;

step j) further comprises connecting the buckstays lying free on the curtain walls to the boiler wall; and step k) further comprises subsequently dismantling the curtain wall cross-ties with the suspension equipment.

* * * * *